US006032651A

United States Patent [19]

Field

[11] Patent Number: 6,032,651

[45] Date of Patent: Mar. 7, 2000

[54] FUEL RAIL DAMPER

[75] Inventor: Jeff Field, Hampton, Va.

[73] Assignee: Siemens Automotive Corporation, Auburn Hills, Mich.

[21] Appl. No.: 09/086,084

[22] Filed: May 28, 1998

[51] Int. Cl.[7] ..... F02M 41/00

[52] U.S. Cl. ..... 123/467; 138/30

[58] Field of Search ..... 138/30; 123/467, 123/456, 457, 468–470

[56] References Cited

U.S. PATENT DOCUMENTS

| | | |
|---|---|---|
| 4,205,637 | 6/1980 | Ito et al. . |
| 4,373,872 | 2/1983 | Kemmner et al. . |
| 4,562,816 | 1/1986 | Dorr . |
| 4,679,537 | 7/1987 | Fehrenbach et al. . |
| 4,991,557 | 2/1991 | DeGrace et al. . |
| 5,088,463 | 2/1992 | Affeldt et al. . |
| 5,111,794 | 5/1992 | DeGrace, Jr. . |
| 5,146,896 | 9/1992 | Imoehl et al. . |
| 5,301,647 | 4/1994 | Lorraine . |

*Primary Examiner*—Thomas N. Moulis

[57] ABSTRACT

A fuel system damper for damping fuel pressure pulsations in a fuel rail includes a solid, flexible diaphragm which separates an upper chamber from a lower chamber. The upper chamber is sealed and contains a spring which is biased against the diaphragm. The lower chamber has an outlet to permit fuel to communicate with the diaphragm. The upper flange of the lower chamber extends inward at an angle to form a radial shoulder, and the diaphragm rests against and is supported by the shoulder. An attachment clip is fixedly attached between the upper and lower chambers and is positioned to securely engage the damper to a fuel injector cup.

10 Claims, 4 Drawing Sheets

FUEL RAIL DAMPER

FIELD OF THE INVENTION

This invention relates to a damper for automotive fuel systems, and more particularly to a damper for eliminating fuel pressure pulsations in a fuel rail.

BACKGROUND OF THE INVENTION

Most returnless fuel delivery systems which use an in-tank fuel pressure regulator require an energy absorbing device mounted on or near the fuel rail. The energy absorbing device serves to compensate for fuel pressure pulsations created in the fuel rail that occur as a result of sequential firing of the fuel injectors.

A current method of absorbing these fuel pressure pulsations is to use a rather large damper. The large damper uses a diaphragm sub assembly which includes a diaphragm, seat and retainer. This sub assembly requires a separate assembly line, and thus is costly and time-consuming to manufacture. Currently, many conventional diaphragms use a crimped center piece which can cut the diaphragm if improperly crimped to the diaphragm during assembly. In order to mount this type of damper on a fuel rail, a large cup must be brazed to the rail. The damper is then sealed in the cup about its circumference with a large o-ring located between the damper and cup. A separate circlip is then used to secure the damper in the cup. Thus, current dampers are large, complex and difficult to assemble and mount, and costly.

SUMMARY OF THE INVENTION

A fuel system damper is provided for damping fuel pressure pulsations in a fuel rail. The damper includes a solid, flexible diaphragm which separates an upper chamber from a lower chamber. The upper chamber is sealed and contains a spring which is biased against the diaphragm. The lower chamber has an outlet to permit fuel to communicate with the diaphragm. The upper flange of the lower chamber extends inward at an angle to form a radial shoulder, and the diaphragm rests against and is supported by the shoulder. The presence of the diaphragm support shoulder permits the elimination of a center piece for the damper experiencing high fuel pressure pulsations; whereas, previously the ability to eliminate the center piece was restricted to low pressure dampers.

An attachment clip is fixedly attached between the upper and lower chambers and is positioned to securely engage the damper to a fuel injector cup. The clip can be built in during the assembly process and thus eliminates the need to add a clip as a separate item when installing the damper on a rail. Also, use of a fuel injector cup to secure the damper eliminates the need to design and build a separate and unique holder for the damper, which reduces cost.

DETAILED DESCRIPTION OF THE INVENTION

Figure 1:
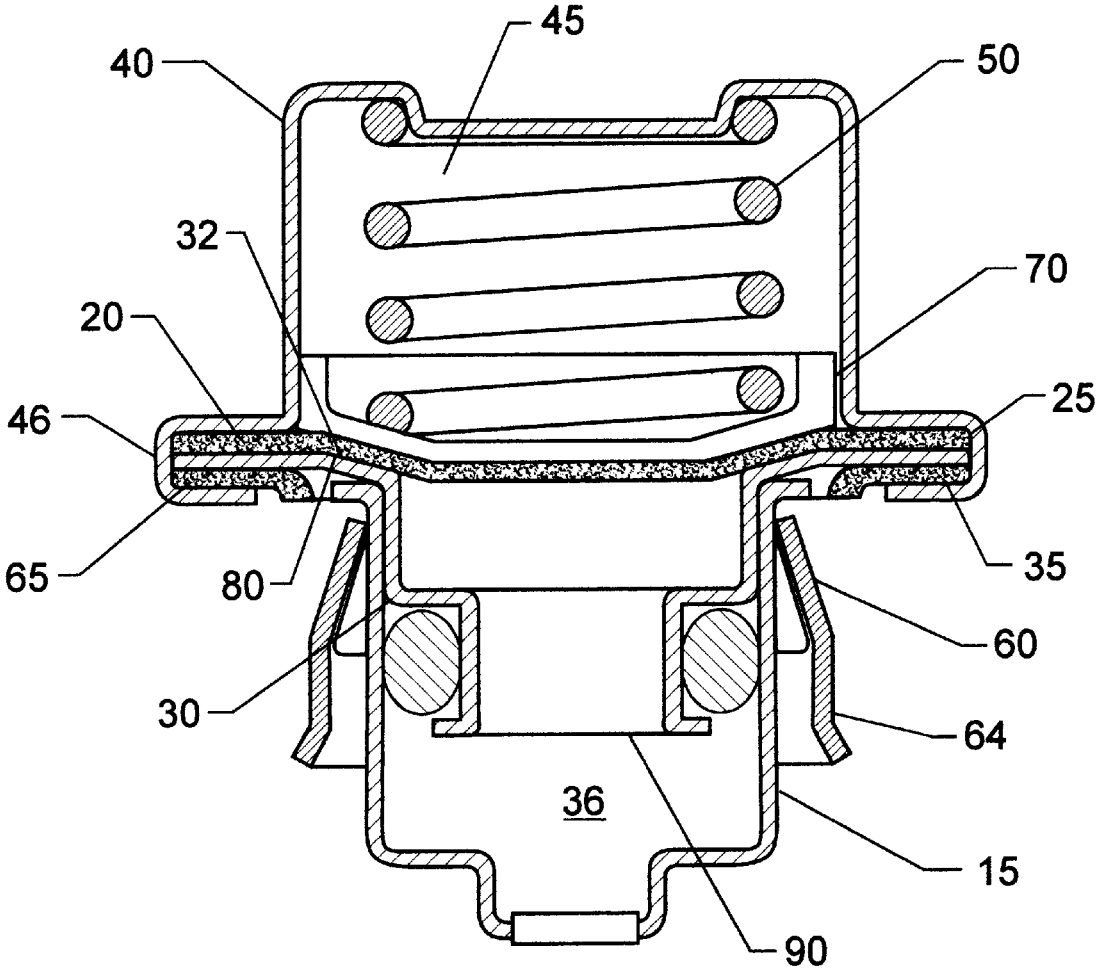
FIG. 1 is a cross section view of a fuel system damper according to the present invention.

As shown in FIG. 1, the damper 10 of the present invention is seated in an injector cup 15 of a fuel rail (not shown) of an automotive fuel system. The damper 10 includes a flexible diaphragm 20 sealed, as for example, by crimping, between a bottom housing 30 and a top cover 40 to form a sealed damping chamber 45. The diaphragm 20 and housing 30 define a bottom chamber 36 that has an outlet 90 to allow fuel from the fuel rail to communicate with the diaphragm 20. The diaphragm 20 is a single piece that is cut from flat material in the shape of a circular disk. Use of this type of diaphragm 20 reduces the number of operations in the assembly process since it does not require the crimped center piece used in a number of conventional diaphragms.

A spring 50 is disposed in the damping chamber 45 and seated in a self-centering spring seat 70 which rests against the diaphragm 20. The spring 50 is supported at one end against the cover 40 and on the other end on the spring seat 70, such that the biasing action of the spring 50 between the spring seat 70 and the top of the cover 40 forces the spring seat 70, and thus the diaphragm 20, downward. The cover 40 has a flange 46 that is crimped over the flange 35 of the housing 30 to grip and seal the outer edge 25 of the diaphragm 20 in place. The housing flange 35 also has a radial sloped upper surface 32 that extends inward and downward to form a shoulder 80 that supports a circumferential portion of the diaphragm 20 when the spring 50 biases the spring seat 70 and diaphragm 20 downward. Thus, in a normal operating condition, the diaphragm 20 rests on the shoulder 80. The spring seat 70 is designed at its lower surface to have a configuration that complements the configuration of the shoulder 80 so that the spring seat 70 presses the diaphragm 20 in full contact with the shoulder 80 between the spring seat 70 and the shoulder 80, and the spring force is evenly distributed across the diaphragm 20. Although the housing can be constructed without the angled slope, the slope has the beneficial effect of permitting the diaphragm to be in an initially deflected position, so that the diaphragm has a broader range of travel possible in response to pressure fluctuations in the fuel rail. Thus, depending on the physical characteristics of the diaphragm material, the slope of the flange can be increased to provide a more deflected resting position of the diaphragm, or decreased to have a smaller initial deflection of the diaphragm.

As is apparent from the illustration in FIG. 1, the diameter of the housing 30 at the inner edge of the shoulder 80 is smaller than the inner diameter of the cover 40 adjacent to the diaphragm 20. The shoulder 80 thus acts as a positive stop so that the diaphragm 20 is not overstroked by the spring 50. The use of the shoulder 80 as a positive stop for the diaphragm 20 also eliminates the need for the type crimped center piece that typically acts as a stop for a diaphragm. As the difference in diameter increases, the area of the shoulder 80 available to support the diaphragm 20 will increase and any detrimental effect on the diaphragm due to compression set will decrease.

Figure 2:
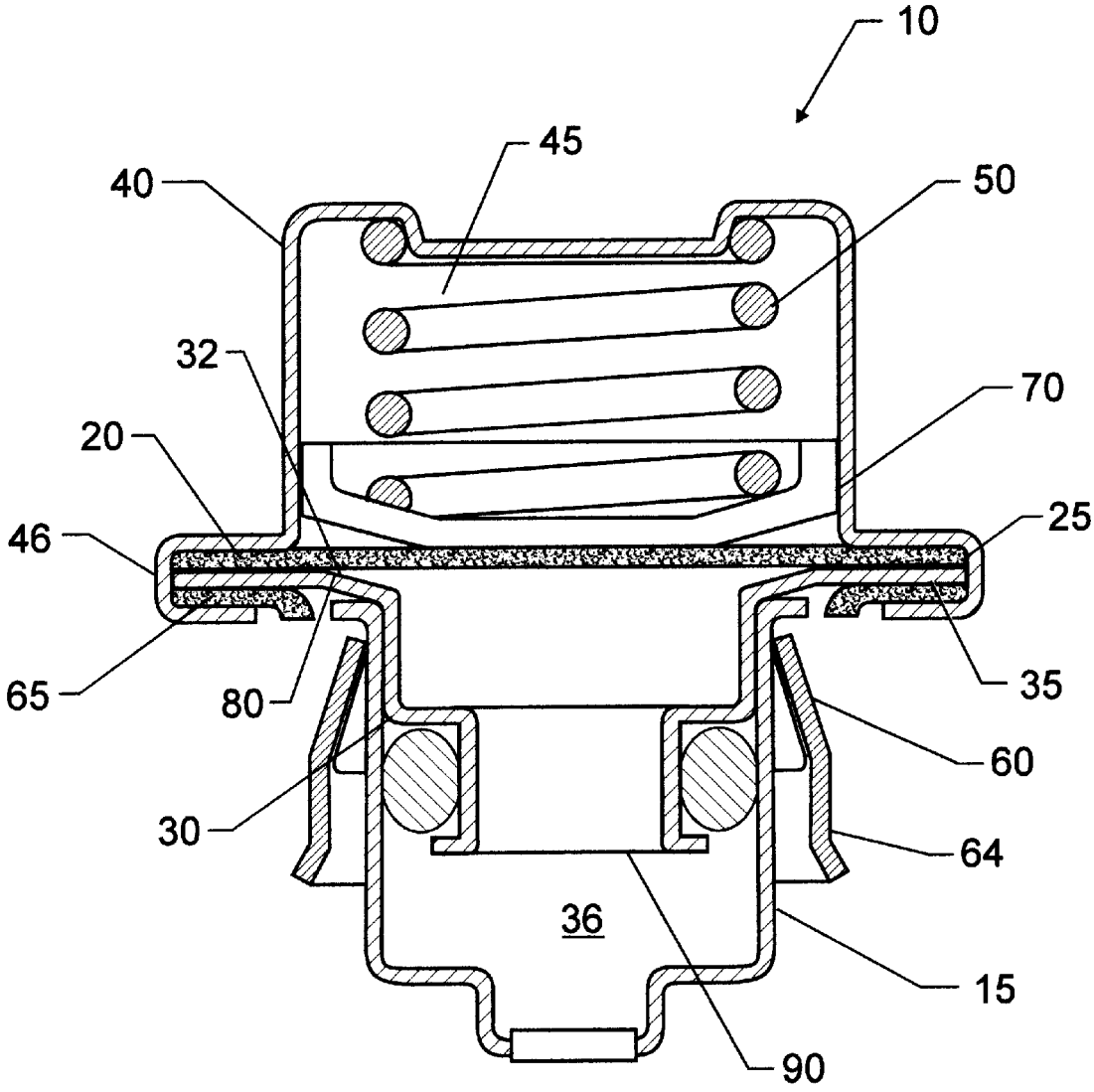
FIG. 2 is a cross section view of the damper of FIG. 1 with the diaphragm responding to a fuel pressure pulsation.

In operation, the diaphragm 20 contacts the full exposed shoulder 80 of the housing 30 due to the biasing action of the spring 50 against the spring seat 70. However, as shown in FIG. 2, as a pressure pulsation occurs in the fuel rail 15, the diaphragm 20 is forced upward, compressing the spring 20. As the pressure pulsation subsides, the spring 50 forces the diaphragm 20 back down towards its initial position against the shoulder 80 as shown in FIG. 1.

Although this damper 10 can be installed in a fuel rail by conventional means such as by securing it with an individual clip, it is particularly advantageous in the preferred embodiment of the present invention to insert and sealingly secure the damper 10 in an injector cup 15 which is attached to the fuel rail. Use of the injector cup requires less space, is lower cost, and requires a smaller, lower cost, o-ring.

Figure 3:
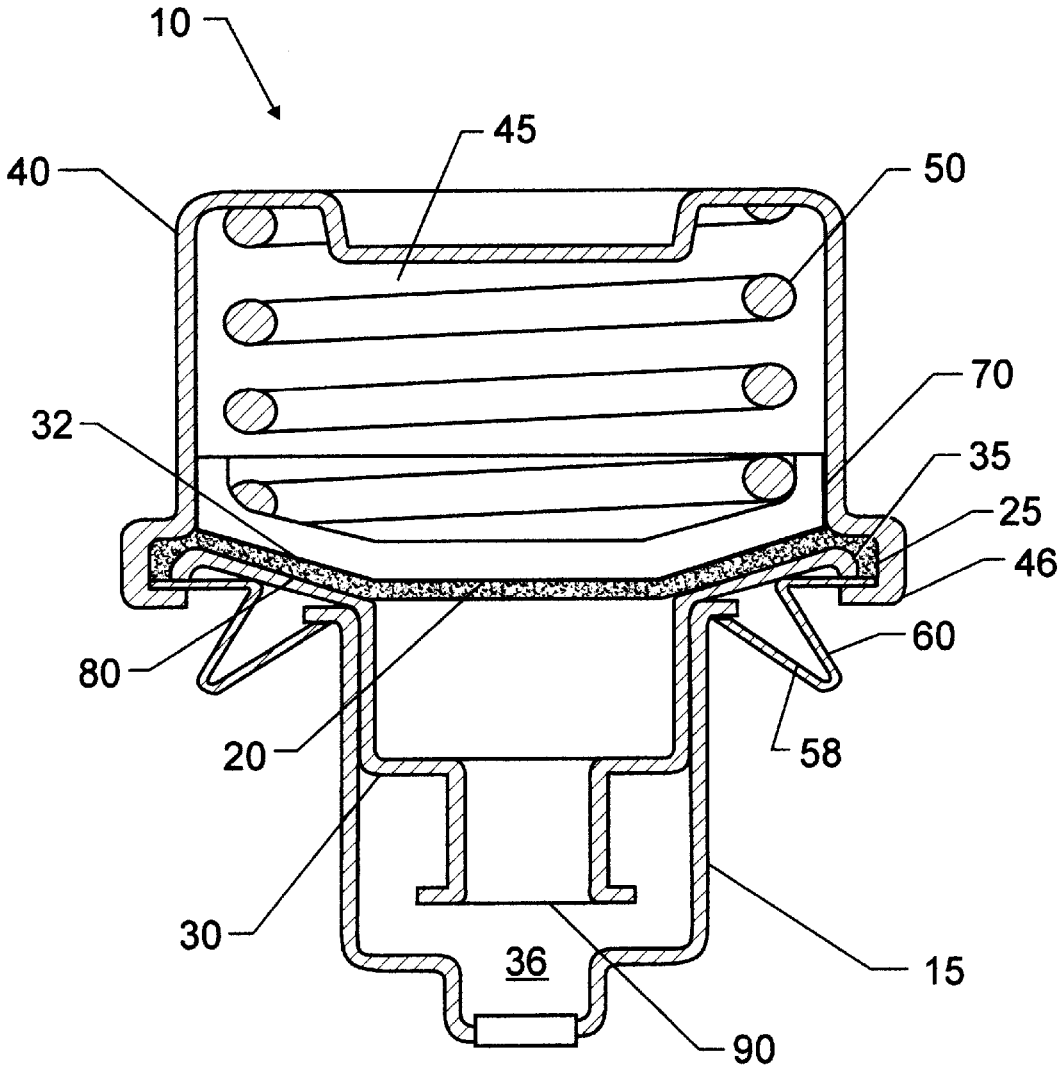
FIG. 3 is another embodiment of the damper of the present invention.
Figure 4:
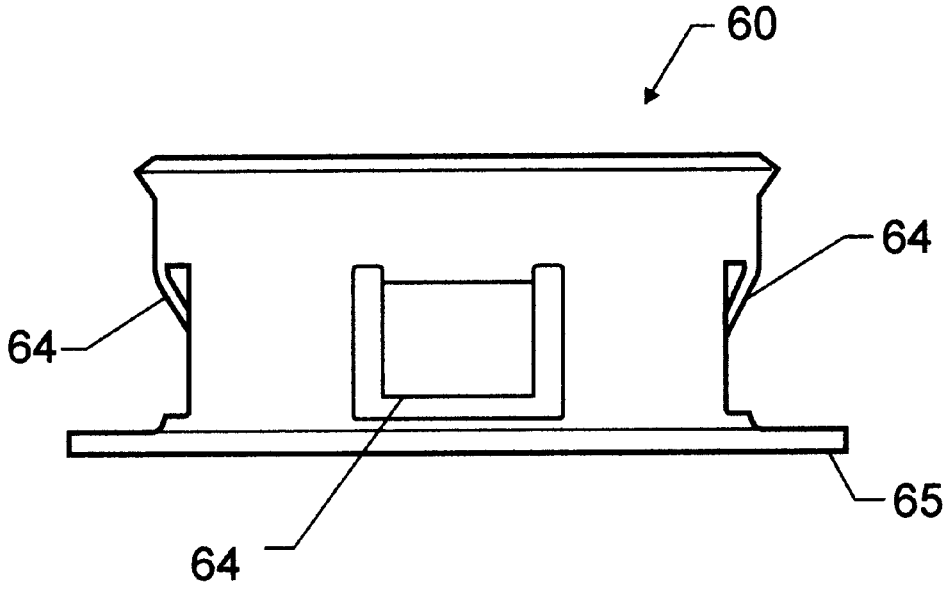
FIG. 4 is a side view of an integral spring clip.
Figure 5:
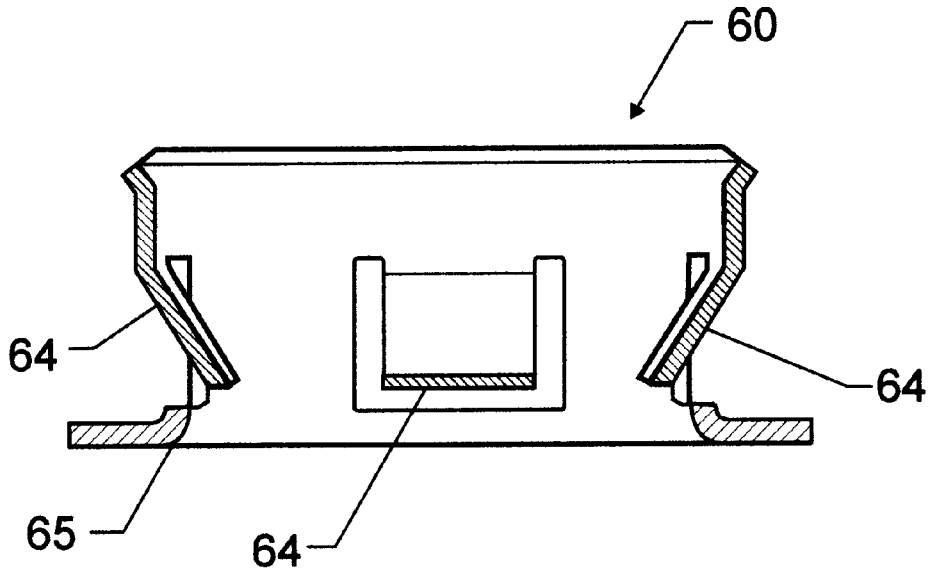
FIG. 5 is a cross section view of the integral spring clip of FIG. 4.

In order to reduce assembly time and simplify installation, the damper 10 may have an integrated clip 60 which is built into the damper 10 during the initial assembly process. For example, an end portion 65 of a spring clip 60 may be crimped between the cover 40 and the housing 30 to secure the clip 60 in place. As shown in FIGS. 2, 4 and 5, the clip 60 has a plurality of legs 64 which extend downward to receive and engage the injector cup 15. Thus, the damper 10 can be secured quickly and easily to the injector cup 15 by inserting the damper 10 into the injector cup 15 until the clip 60 engages the cup 15. As shown in an alternate embodiment in FIG. 3, the design of the engaging portion 58 of the clip 60 can vary as long as it functions to secure the damper 10 to the fuel rail, either directly, or by attachment to a cup such as the injector cup 15. Use of an integral clip 60 eliminates the added step normally required in conventional damper installations of securing the damper to the fuel rail with a separately provided clip.

Numerous further modifications and adaptations of the present invention will become apparent to those skilled in the art. For example, although the presence of the shoulder 80 allows use of a solid diaphragm, if desired, a diaphragm having a center piece can also be used. And, although the damper 10 is shown as inserted in an injector cup 15 for connection to the fuel rail, the damper can be connected to the rail using any conventional attachment means.

The clip 60 has been illustrated as attached to the damper 10 by crimping between flanges between the housing 30 and cover 40, but it also could be attached by any of a variety of suitable means such as bonding, brazing, forming or mechanical attachment.

Thus, the following claims are intended to cover all such modifications and adaptations which fall within the true spirit and scope of the present invention.

What is claimed is:

1. A damper for a fuel system, the damper comprising:

a housing;

a diaphragm separating the housing into a sealed first chamber and a second chamber, the second chamber having an opening to receive fluid having pressure fluctuations and having a radial shoulder adjacent the diaphragm;

a spring seat disposed in the first chamber against the diaphragm; and a spring disposed in the spring seat and biasing the spring seat and the diaphragm toward the radial shoulder, wherein the radial shoulder supports the diaphragm under the biasing action of the spring.

2. The damper of claim 1, wherein the diaphragm is a solid piece.

3. The damper of claim 2, wherein the radial shoulder slopes downward.

4. The damper of claim 3, further comprising a cup member and a clip, wherein the housing is sealingly inserted into the cup member and connected to the cup member by the clip.

5. The damper of claim 4, wherein the cup member is an injector cup.

6. The damper of claim 5, wherein the clip is integrally attached to the housing.

7. The damper of claim 6, wherein first chamber and the second chamber have flanges, and the clip is attached to the housing between the flanges of the first chamber and second chamber.

8. A damper for a fuel system, the damper comprising:

a housing;

a diaphragm separating the housing into a sealed first chamber and a second chamber, the second chamber having an opening to receive fluid having pressure fluctuations and having a diaphragm support means adjacent the diaphragm;

a biasing means disposed in the first chamber and biasing the diaphragm toward the diaphragm support means, wherein the diaphragm support means limits the motion of the diaphragm under the biasing action of the biasing means;

an injector cup; and an engagement means, wherein the housing is sealingly disposed in the injector cup and connected to the injector cup by the engagement means.

9. The damper of claim 8, wherein the engagement means is a clip integrally attached to the housing.

10. The damper of claim 9, wherein the diaphragm support means is a downward sloping radial shoulder.

* * * * *